US011015289B2

(12) United States Patent
Baser

(10) Patent No.: US 11,015,289 B2
(45) Date of Patent: May 25, 2021

(54) PROCESS FOR DYEING OF TEXTILE MATERIALS USING SUPERCRITICAL FLUID

(71) Applicant: Swapneshu Ashok Baser, Mumbai (IN)

(72) Inventor: Swapneshu Ashok Baser, Mumbai (IN)

( * ) Notice: Subject to any disclaimer, the term of this patent is extended or adjusted under 35 U.S.C. 154(b) by 198 days.

(21) Appl. No.: 16/336,936

(22) PCT Filed: Oct. 25, 2017

(86) PCT No.: PCT/IN2017/050492
§ 371 (c)(1),
(2) Date: Mar. 27, 2019

(87) PCT Pub. No.: WO2018/078651
PCT Pub. Date: May 3, 2018

(65) Prior Publication Data

US 2019/0264383 A1 Aug. 29, 2019

(30) Foreign Application Priority Data

Oct. 27, 2016 (IN) ..... 201621036972

(51) Int. Cl.
*D06P 1/00* (2006.01)
*D06P 1/94* (2006.01)
(Continued)

(52) U.S. Cl.
CPC ..... *D06P 1/94* (2013.01); *D06B 19/00* (2013.01); *D06P 1/0096* (2013.01);
(Continued)

(58) Field of Classification Search
CPC ..... D06P 1/94; D06P 5/2066; D06P 5/2044; D06P 5/2061; D06P 1/0096; D06P 5/30;
(Continued)

(56) References Cited

U.S. PATENT DOCUMENTS 6,048,369 A * 4/2000 Smith ..... D06B 23/20 8/475
2002/0108183 A1* 8/2002 Smith ..... D06M 23/105 8/115.51
(Continued)

OTHER PUBLICATIONS

English transaltion of the Patent No. CN104195854 A dated Jan. 12, 2021.*

*Primary Examiner* — Eisa B Elhilo

(57) ABSTRACT

An embodiment herein provides a process for dyeing of textile materials 108 with supercritical fluid. One or more dye materials 102 along with additives (if required) are mixed with at least one suitable solvent 104 to obtain one or more dye solutions 106. A textile material 108 is pre-treated with the one or more dye solutions 106 to obtain a dye coated textile material 110. The dye-coated textile material 110 is exposed to the supercritical fluid 112 in a supercritical fluid dyeing vessel at controlled pressure and temperature. The supercritical fluid 112 solubilizes and diffuses the one or more dye materials 102 inside the surface, pores and capillaries of the textile material 108. The supercritical fluid vessel is then depressurized below supercritical condition to entrap the one or more dye materials 102 in the textile material 108 to obtain a supercritical fluid dyed textile material 114.

6 Claims, 2 Drawing Sheets

(51) Int. Cl.

| | |
|---|---|
| ***D06P 5/20*** | (2006.01) |
| ***D06B 19/00*** | (2006.01) |
| ***D06P 5/30*** | (2006.01) |
| *D06B 9/02* | (2006.01) |
| *D06B 23/20* | (2006.01) |
| *D06B 23/16* | (2006.01) |

(52) U.S. Cl.
CPC ..... *D06P 5/2044* (2013.01); *D06P 5/2061* (2013.01); *D06P 5/2066* (2013.01); *D06P 5/30* (2013.01); *D06B 9/02* (2013.01); *D06B 23/16* (2013.01); *D06B 23/205* (2013.01)

(58) Field of Classification Search
CPC ..... D06B 19/00; D06B 23/205; D06B 9/02; D06B 23/16; D06B 19/0005
USPC ..... 8/475
See application file for complete search history.

(56) References Cited

U.S. PATENT DOCUMENTS

2016/0244911 A1* 8/2016 Kelly ..... D06P 5/2055
2016/0244912 A1* 8/2016 Kelly ..... D06P 5/003

* cited by examiner

PROCESS FOR DYEING OF TEXTILE MATERIALS USING SUPERCRITICAL FLUID

BACKGROUND

Technical Field

The embodiments herein generally relate to dyeing of textile materials, and, more particularly, to a process for efficiently dyeing the textile materials with one or more dye materials using supercritical fluid.

Description of the Related Art

Supercritical fluid based textile dyeing process is environment friendly, green process that minimizes environmental, water pollution issues faced by the conventional textile dyeing industry. In a typical supercritical fluid based dyeing process, a dye material is first dissolved in the supercritical fluid. The supercritical fluid along with the dissolved dye molecules is then passed over the textile material in the supercritical dyeing vessel. The dye from supercritical fluid thus comes in contact with textile material to achieve dying operation. One of the primary reasons for the limited success for the typical supercritical dyeing process being its slow rate of action due to low solubility of dye materials in supercritical fluids. Further, limitation being that only part of the dye material, which is dissolved in the supercritical fluid, actually comes in contact with a surface of the textile material to contribute in dyeing process and the rest of the dye material just passes through the empty spaces present in and between the textile materials, without actually coming in contact with the surface of the textile material for achieving dyeing operation. Further, even out of the dissolved dye material, which actually comes in contact with the surface of the textile material, only a small amount of the dye material penetrates inside the surface, pores, capillaries etc. of the textile material. This may be mainly due to shorter residence time of the dynamic supercritical fluid, flowing through the supercritical dyeing vessel. This limits a quantity of dye molecules that diffuses inside the textile material. The unused dissolved dye material in supercritical fluid coming out of dyeing vessel is then flows to a separator vessel, where the pressure and temperature of the supercritical fluid is reduced to subcritical state to reduce the solubility of dye molecules, resulting in precipitation and recovery of the unused dye material.

Therefore, the above mentioned supercritical dyeing process has the limitations of: (i) low solubility of the dye material in the supercritical fluid giving low concentration of dye in supercritical fluid being used as dyeing medium, (ii) Further, only a fraction of the dissolved dye material is able to come in contact with the surface of the textile material, and (iii) Low residence time (i.e. a time available for dye molecule between entry into and exit out of dyeing vessel) limits the contact, interaction between textile material surface and the dye molecules. The aforementioned limitations collectively result in a situation that only a part of the dissolved dye in the supercritical fluid gets a chance to penetrate inside textile material matrix to achieve desired colour intensity and fastness. This also makes the existing supercritical dyeing process less versatile, slow and inefficient. Hence, there remains a need for an improved dyeing process that effectively facilitates interaction of the dye molecules with the surface of the textile material, to increase the rate and efficiency of dyeing process using supercritical fluids. Further, the existing supercritical dyeing process that involves pre-dissolution of dye molecules in the supercritical fluid, has a major limitation of being able to apply only a single color shade at a time on the textile material. The above said existing supercritical dyeing process limits the possibility of applying multiple colors simultaneously or of applying controlled variations of shade along the width of the textile material or formation of desired design patterns on the textile material. The market also has demand for textiles with multiple colors, shades, patterns etc. Hence, there is also a need for applying multiple colors, shades, patterns etc. on the textile material in single operation of supercritical fluid based dyeing process.

Accordingly, there remains a need for an improved supercritical fluid based dyeing process for efficient dyeing of the textile materials with single or multi-colors in various shades, patterns, designs etc., preferably in a single dyeing step.

SUMMARY

In view of foregoing, an embodiment herein provides a process for dyeing of textile material using supercritical fluid. The process includes the steps of: (a) mixing at least one dye material in at least one suitable solvent to obtain at least one dye solution; (b) pre-treating a surface of the textile material with an optimum quantity of the at least one dye solution to obtain a dye coated textile material; (c) placing the dye coated textile material in a supercritical fluid dyeing vessel; (d) adding a supercritical fluid into the supercritical fluid dyeing vessel at controlled temperature and pressure, wherein the supercritical fluid solubilizes the at least one dye material which is present on the surface of the dye coated textile material and further diffuses the solubilized at least one dye material inside the surface, pores and capillaries of the textile material; and (f) depressurizing the supercritical fluid dyeing vessel to precipitate and entrap the at least one dye material in the textile material.

In one embodiment, the at least one dye material along with additives are mixed with at least one suitable solvent to obtain at least one dye solution. In an embodiment, the additives are at least one of dispersing agents, emulsifiers, surface active agents etc.

In an embodiment, the controlled temperature ranges from 35° C. to 150° C. In another embodiment, the controlled pressure ranges from 100 Bar to 700 Bar.

In another embodiment, the process further includes the steps of: treating the dye coated textile material using a suitable process to control at least one of (i) moisture and/or (ii) solvent content of the dye coated textile material.

In yet another embodiment, the surface of the textile material is pre-treated with more than one dye solution to obtain a multi-color, multi shade dyed textile material with desired design patterns as required.

In yet another embodiment, the surface of the textile material is pre-treated with the at least one dye solution using a method similar to ink jet printing.

In yet another embodiment, the method similar to ink jet printing is performed using a single jet printing and/or a multi-jet printing.

In yet another embodiment, the surface of the textile material is pretreated with the at least one dye solution using any desired coating process to obtain a desired thickness and concentration of the at least one dye material on the surface of the textile material.

In yet another embodiment, the process comprising maintaining the controlled temperature and pressure of the supercritical fluid at optimum level to have desirable solubility for coated dye molecules in the supercritical fluid, to help in swelling of pores and capillaries of the dye coated textile material, and to contribute in reducing glass transition temperature of the textile material. The optimum value or the optimum level for temperature and pressure may vary with nature and solubility of dye molecule, type of the textile material and their interaction with the supercritical fluid used for the dyeing process.

In yet another embodiment, at least one type of dye molecules penetrates inside the surface, the pores and capillaries of the textile material along with the supercritical fluid which acts as solvent.

In one aspect, a method for dyeing of a textile material using supercritical fluid is provided. The method includes the following steps of: (A) mixing at least one dye molecule in a suitable solvent along with additives to obtain at least one dye solution; (B) pre-treating the surface of the textile material with an optimum quantity of the at least one dye solution to obtain a dye coated textile material; (C) treating the coated textile material using a suitable process to control (i) moisture and/or (ii) solvent content of the dye coated textile material; (D) placing the coated textile material in a supercritical fluid dyeing vessel; (E) adding a supercritical fluid into the supercritical fluid dyeing vessel at controlled temperature and pressure, wherein the supercritical fluid (i) solubilizes the at least one dye molecule which is present on the surface of the dye coated textile material and (ii) diffuses the at least one dye molecule inside the surface, pores and capillaries of the textile material; and (F) depressurizing the supercritical fluid dyeing vessel to precipitate and entrap the at least one dye molecule in the textile material.

This process of dyeing of textile materials with supercritical fluid provides the textile material dyed with multicolor and with desired design patterns in an efficient way. The process of dyeing of textile materials with the supercritical fluid by pre-treating the textile material with the one or more dye solutions using any suitable method (e.g. ink jet printing, multi jet printing, coating, spraying etc.) reduces the wastage of the one or more dye materials. Further, this process of dyeing of textile materials with supercritical fluid enables in achieving desired uniform color or color pattern, design on the textile material in a single step. This process of dyeing of textile materials with supercritical fluid is simpler, versatile and efficient. This process also makes scale up of the dyeing process easier as the dye molecules are already present on the entire surface of the textile material that needs to be dyed and therefore the dye molecules are not required to be transported to the textile material surface, along with supercritical fluid to reach uniformly at each part of the material that needs to be dyed.

This process or method may also be used for dyeing of materials other than textiles. This process or method may also be used for controlled treatment of materials with desired chemicals by pre-coating of the treatment chemicals on material surface before exposing the material to supercritical fluid, rather than need for pre-dissolving the treatment chemicals in supercritical fluid, for other processes which require Supercritical Fluid assisted penetration of such treatment or reaction chemicals, in the desired matrix to achieve reactions, modification in properties of the matrix material etc.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
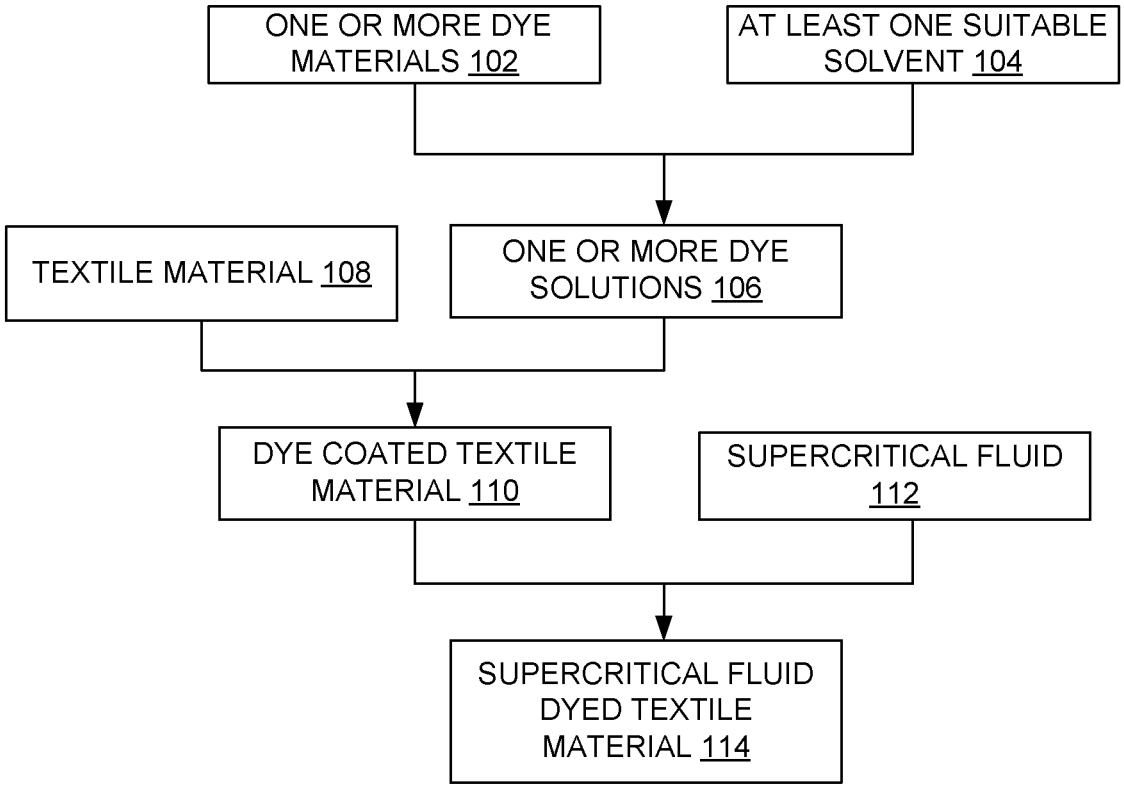
FIG. 1 is a flow diagram that illustrates a process of dyeing of textile materials using supercritical fluid according to an embodiment herein.
Figure 2:
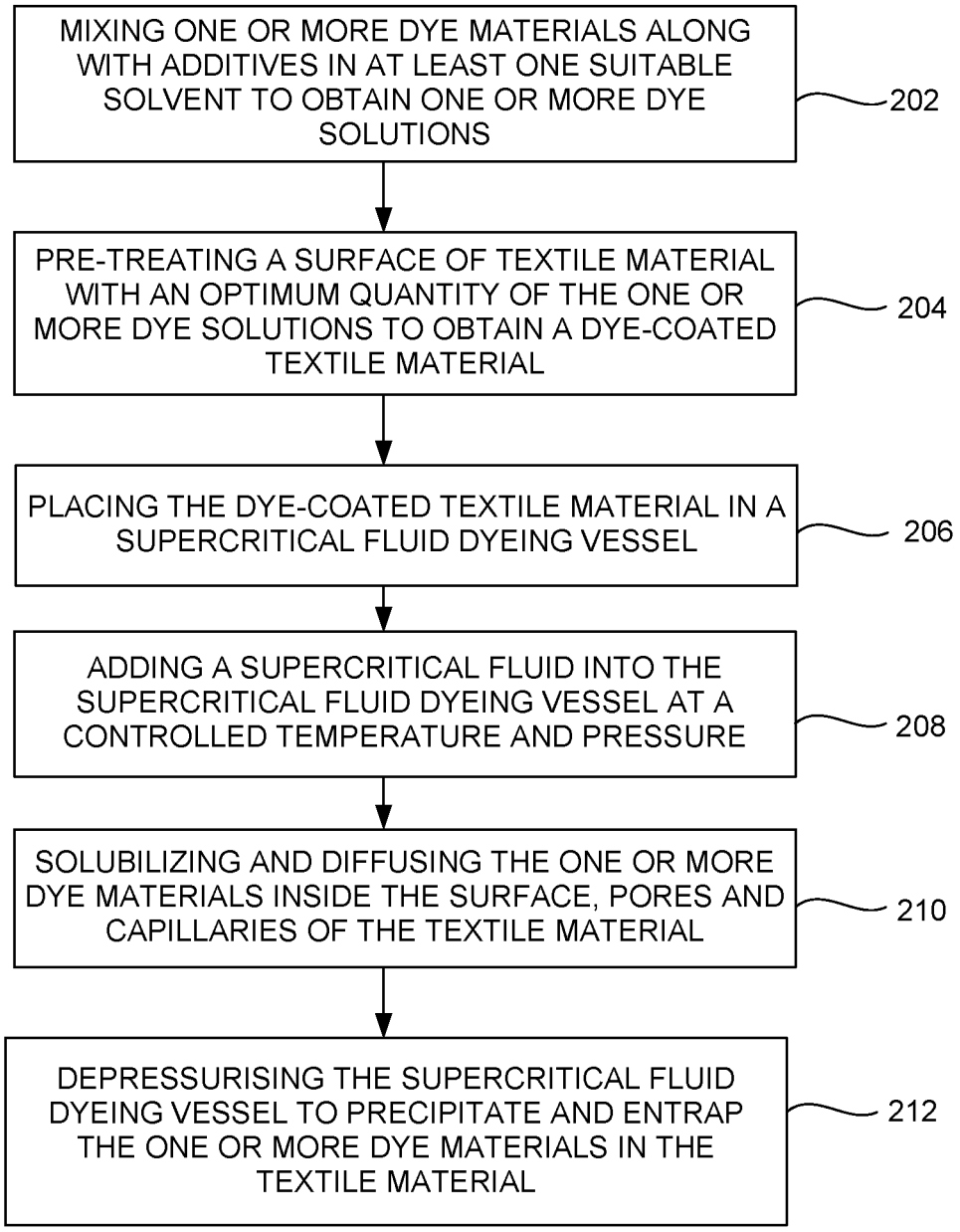
FIG. 2 is a flow diagram that illustrates a method of dyeing of textile materials using supercritical fluid according to an embodiment herein.

As mentioned, there remains a need for an improved process for efficiently dyeing of textile materials using supercritical fluid. The embodiments herein achieve this by providing a process that involves pre-coating of the textile material with one or more dye materials and then exposing the dye coated textile material to the supercritical fluid, under supercritical conditions. The supercritical fluid that diffuses inside the textile material may swell the matrix and may reduce the glass transition temperature of the textile material. This helps in opening the pores and capillary structure of textile material. Simultaneously, the supercritical fluid dissolves the dye molecules present on the surface of the pre-coated textile material and further helps them to penetrate deep inside the textile material resulting in efficient dyeing with good color fastness. Referring now to the drawings, and more particularly to FIGS. 1 through 2, where similar reference characters denote corresponding features consistently throughout the figures, preferred embodiments are shown.

FIG. 1 is a flow diagram that illustrates a process of dyeing of textile materials 108 with supercritical fluid according to an embodiment herein. One or more dye materials 102 are mixed in at least one suitable solvent 104 (e.g. water, acetone, ethanol, hexane etc. or any other solvent depending on the suitability for the dye molecule) along with any additives (e.g. dispersing agents, emulsifiers, surface active agents etc.) (if required) to obtain one or more dye solutions 106. The textile material 108 is then pre-treated with the one or more dye solutions 106 to obtain a dye coated textile material 110. In one embodiment, the textile material 108 is pre-treated with the one or more dye solutions 106 to obtain the dye coated textile material 110 having uniform coating with desired layer thickness and desired concentration of the one or more dye materials 102 on the surface of the textile material 108. Pre-treating the surface of the textile material 108 provides desired concentration of the one or more dye materials 102 (e.g. dye molecules) with specific and uniform intensity of color on the surface of the textile material 108 and reduces wastage of one or more dye materials 102, and improves utilization of the one or more dye materials 102.

In one embodiment, the textile material 108 is pre-treated with the one or more dye solutions 106 using any suitable technique or process that is used for coating or spreading of dye solution on the surface of textile materials with uniform and desired concentration of dye molecules. In an embodiment, the pre-coating the surface of the textile material 108 with the one or more dye solutions 106 may be achieved with an inkjet printing and/or a multi-jet printing or any suitable method to obtain the dye-coated textile material 110 in a single and/or multi-color with desired patterns, shades etc. as required.

In yet another embodiment, the textile material 108 is pre-treated with the one or more dye solutions 106 using ink jet printing or multi-jet printing to obtain the dye-coated textile material 110 with controlled, optimum quantity of dye molecules per unit textile surface to achieve desirable reproducibility of final color shade and desired color intensity. This facilitates the possibility of having multi-colour designs on the textile while dyeing using supercritical fluids. In yet another embodiment, the pre-treatment of the textile material 108 with the one or more dye solutions 106 controls concentration of the one or more dye materials 102 per unit area on the surface of the textile material 108 to obtain a specific and uniform intensity of color on the textile material 108, and also improves efficient utilization of the one or more dye materials 102. In yet another embodiment, the pre-treatment of the textile material 108 with the one or more dye solutions 106 helps in penetration of the one or more of dye materials 102 inside the pores and capillaries of the textile material 108.

The dye-coated textile material 110 is then exposed to the supercritical fluid 112 in a supercritical fluid dyeing vessel. The dye-coated textile material 110 may be subjected to a suitable process like drying etc., before loading the dye-coated textile material 110 into the supercritical fluid dyeing vessel, to control level of residual moisture and/or solvent content of the dye-coated textile material 110. The supercritical fluid 112 (e.g. supercritical carbon dioxide) solubilizes and diffuses the one or more dye materials 102 inside the surface, pores and capillaries of the dye-coated textile material 110 at a controlled temperature and pressure inside the supercritical fluid dyeing vessel. In yet another embodiment, the pre-coating by the one or more dye materials 102 on the surface of the textile material 108 results in a desired thin layer of dye material that helps in effective contact of the one or more dye materials 102 with the supercritical fluid 112. This helps in higher solubility and concentration of dye molecules in supercritical medium, near the surface of the textile material that needs to be dyed. This also avoids inefficiencies that may be possible due to undesirable channeling of dye dissolved supercritical fluid, which result in non-uniformity in dyeing as observed in conventional supercritical fluid based dyeing processes.

The supercritical fluid dyeing vessel is then depressurized to entrap the one or more dye materials 102 that is diffused inside the textile material 108 to obtain a supercritical fluid dyed textile material 114.

FIG. 2 is a flow diagram that illustrates a method of dyeing a textile material 108 under a supercritical condition according to an embodiment herein. At step 202, one or more dye materials 102 is mixed along with additives in at least one suitable solvent 104 to obtain one or more dye solutions 106. At step 204, the textile material 108 is pre-treated with the one or more dye solutions 106 to obtain a dye-coated textile material 110. Then, the dye-coated textile material 110 may be processed by a suitable method to control residual moisture and/or the solvent content of the dye-coated textile material 110. At step 206, the dye-coated textile material 110 is then placed in a supercritical fluid dyeing vessel. At step 208, the dye-coated textile material 110 is exposed to the supercritical fluid, inside the supercritical fluid dyeing vessel at a controlled temperature and pressure which are above the critical temperature and pressure of the supercritical solvent. At step 210, the supercritical fluid 112 solubilizes and diffuses the one or more dye materials 102 inside the surface, pores and capillaries of the textile material 108. At step 212, the supercritical fluid vessel is then depressurized to entrap the one or more dye materials 102 that is diffused in the textile material 108 to obtain a supercritical fluid dyed textile material 114. In an embodiment, the supercritical fluid 112 inside the supercritical fluid dyeing vessel is maintained at the controlled temperature and pressure for achieving desired solubility for coated dye molecules in the supercritical fluid, for swelling of the pores and capillaries of the textile material 108, and for reducing the glass transition temperature of the textile material 108. These effects also help in efficient diffusion of the dye molecules inside the textile material 108 to achieve efficient dyeing. The supercritical condition is achieved by maintaining the temperature and pressure above the critical temperature and critical pressure of the said fluid.

The foregoing description of the specific embodiments will so fully reveal the general nature of the embodiments herein that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

I claim:

1. A process for dyeing a textile material 108 using supercritical fluid 112, comprising:

mixing at least one dye material 102 in at least one solvent 104 to obtain at least one dye solution 106, wherein the at least one solvent 104 comprises at least one of water, acetone, ethanol, or hexane;

pre-treating a surface of said textile material 108 with a quantity of said at least one dye solution 106 to obtain a dye coated textile material 110 with a controlled quantity of dye molecules per unit textile surface to achieve desirable reproducibility of final color shade and desired color intensity, wherein a thin uniform layer of said at least one dye material 102 on said surface of said textile material 108 enables an effective contact of said at least one dye material 102 with said supercritical fluid 112 acting also as solvent for said at least one dye material 102;

treating said dye coated textile material 110 using a drying process to control a level of at least one of (i) moisture and/or (ii) solvent content of said dye coated textile material 110;

placing said dye coated textile material 110 in a supercritical fluid dyeing vessel;

characterized in that the process further includes, adding said supercritical fluid 112 into said supercritical fluid dyeing vessel at a controlled temperature and pressure, wherein said controlled temperature ranges from 35° C. to 150° C. and said controlled pressure ranges from 100 Bar to 700 Bar, wherein said controlled temperature and pressure are determined based on the nature and solubility of dye molecule in said supercritical fluid 112, a type of said textile material 108 and their interaction with said supercritical fluid 112 being used as solvent for said dyeing process;

solubilizing said thin uniform layer of said at least one dye material 102 on said surface of said textile material 108 using said supercritical fluid 112 as a solvent to obtain a higher solubility and concentration of dye molecules in said supercritical fluid 112 on said surface of said textile material 108 due to a presence of said thin uniform layer of said at least one dye material 102 on surface of said dye coated textile material 110 and further diffusing said solubilized at least one dye material 102 inside the surface, pores and capillaries of said textile material 108; and depressurizing said supercritical fluid dyeing vessel below supercritical condition to precipitate and entrap said at least one dye material 102 in the said textile material 108.

2. The process as claimed in claim 1, wherein said at least one dye material 102 is mixed with additives, and then mixed with said at least one solvent 104 to obtain said at least one dye solution 106, wherein said additives are at least one of dispersing agents, emulsifiers, and surface active agents.

3. The process as claimed in claim 1, wherein said surface of said textile material 108 is pre-treated with more than one dye solution to obtain a multi-color, multi shade coated textile material with desired design patterns as required, wherein said surface of said textile material 108 is pre-treated with said at least one dye solution 106 using an ink jet printing, and wherein said ink jet printing is performed using a single jet printing and/or a multi jet printing.

4. The process as claimed in claim 1, wherein said surface of said textile material 108 is pre-treated with said at least one dye solution using a coating process to obtain a desired thickness and concentration of said at least one dye material 102 on said surface of said textile material 108.

5. The process as claimed in claim 4, wherein said process comprises maintaining said controlled temperature and pressure of said supercritical fluid 112 at a level to have desirable solubility for coated dye molecules in said supercritical fluid 112, to help in swelling of pores and capillaries of said dye coated textile material 110, and to contribute in reducing glass transition temperature of said textile material 108.

6. The process as claimed in claim 5, wherein at least one type of dye molecules penetrates inside said surface, said pores and capillaries of said textile material 108 along with said supercritical fluid 112 which acts as solvent.

* * * * *